US006684888B1

(12) United States Patent
Seabury

(10) Patent No.: US 6,684,888 B1
(45) Date of Patent: Feb. 3, 2004

(54) LIPSTICK BLOTTER

(76) Inventor: Mary C. Seabury, 2145 Hummingbird, Missoula, MT (US) 59808

( * ) Notice: Subject to any disclaimer, the term of this patent is extended or adjusted under 35 U.S.C. 154(b) by 40 days.

(21) Appl. No.: 10/062,643

(22) Filed: Jan. 30, 2002

Related U.S. Application Data

(60) Provisional application No. 60/265,047, filed on Jan. 30, 2001.

(51) Int. Cl.[7] ..... A45D 40/26; A45D 40/24

(52) U.S. Cl. ..... 132/320; 132/317; 132/318

(58) Field of Search ..... 132/320, 317, 132/318; 128/66.7, 64.1, 80, 99

(56) References Cited

U.S. PATENT DOCUMENTS

| | | | | | |
|---|---|---|---|---|---|
| 1,744,532 | A | | 1/1930 | Ean | |
| 1,820,259 | A | * | 8/1931 | Wandel | 132/317 |
| 1,885,076 | A | * | 10/1932 | Bustamante | 132/317 |
| 2,606,565 | A | * | 8/1952 | Sage | 132/317 |
| 2,615,563 | A | | 10/1952 | Sundberg et al. | |
| 2,669,113 | A | | 2/1954 | Gillette | |
| 2,735,435 | A | * | 2/1956 | Feinstein | 132/320 |
| 2,851,076 | A | | 9/1958 | Stakofsky | |
| 3,095,087 | A | | 6/1963 | Yates | |
| 3,150,808 | A | | 9/1964 | Vensel | |
| 3,432,081 | A | | 3/1969 | Forte | |
| 3,955,233 | A | * | 5/1976 | Nakamura | 132/317 |
| 4,053,242 | A | | 10/1977 | Mast, Jr. | |
| 4,101,053 | A | | 7/1978 | Mast, Jr. | |
| 4,611,611 | A | * | 9/1986 | Beal | 132/317 |
| 4,838,851 | A | * | 6/1989 | Shabo | 604/1 |
| 4,998,621 | A | | 3/1991 | Meehan | |
| D354,374 | S | | 1/1995 | Battaglia | |
| 6,013,344 | A | | 1/2000 | Corbins | |
| 6,251,408 | B1 | | 6/2001 | Dobler | |

* cited by examiner

*Primary Examiner*—John J. Wilson
*Assistant Examiner*—Robyn Kieu Doan
(74) *Attorney, Agent, or Firm*—Richard C. Conover

(57) ABSTRACT

A lipstick blotter having a plurality of identically-shaped sheets of soft, absorbent material joined together one upon the other. The sheets having a generally triangular shape with a base edge located at the base of the triangular shape and an apex edge located opposite the base edge. The joined sheets provided with a finger grip located on an outside surface of the joined sheets and adjacent the base edge of the joined sheets. The upper apex edge used for inserting between the open lips of a user.

18 Claims, 2 Drawing Sheets

LIPSTICK BLOTTER

This application claims the benefit of U.S. Provisional Application Ser. No. 60/265,047 field Jan. 30, 2001.

BACKGROUND OF THE INVENTION

The present invention relates to a lipstick blotter which can be used by a woman to free and clear lipstick from a user's lips when lipstick is initially applied.

When women apply lipstick with a lipstick tube, there is often left on the lips excess lipstick, or oftentimes the lipstick is not applied uniformly. Such women have a need for a convenient lipstick blotter to remove the excess lipstick or smooth the lipstick already applied. The lipstick blotter needs to have sufficient rigidity so that a user can use the blotter for its intended purpose. The lipstick blotter needs to have a finger gripping area to allow the user to properly use the lipstick blotter. Further, the lipstick blotter preferably needs to have a narrower edge opposite the finger gripping area to allow for easy insertion between the open lips of the user.

SUMMARY OF INVENTION

A lipstick blotter having a plurality of identically-shaped sheets of soft, absorbent material joined together one upon the other. The sheets having a generally triangular shape with a base edge located at the base of the triangular shape and an apex edge located opposite the base edge. The joined sheets provided with a finger grip located on an outside surface of the joined sheets and adjacent the base edge of the joined sheets. The upper apex edge used for inserting between the open lips of a user.

DESCRIPTION OF THE DRAWINGS

In order that the invention may be clearly understood and readily carried into effect, a preferred embodiment of the invention will now be described, by way of example only, with reference to the accompanying drawings wherein.

DESCRIPTION OF A PREFERRED EMBODIMENT

Figure 1:
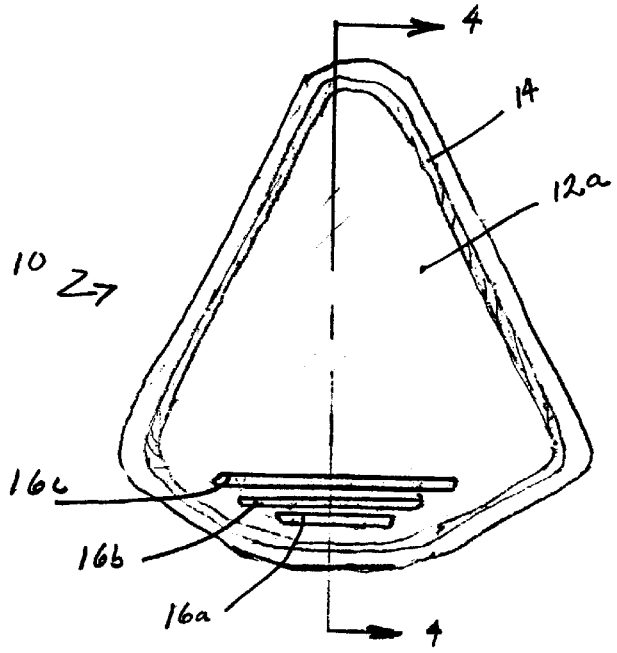
FIG. 1 is a top plan view of a lipstick blotter according to the present invention.
Figure 2:
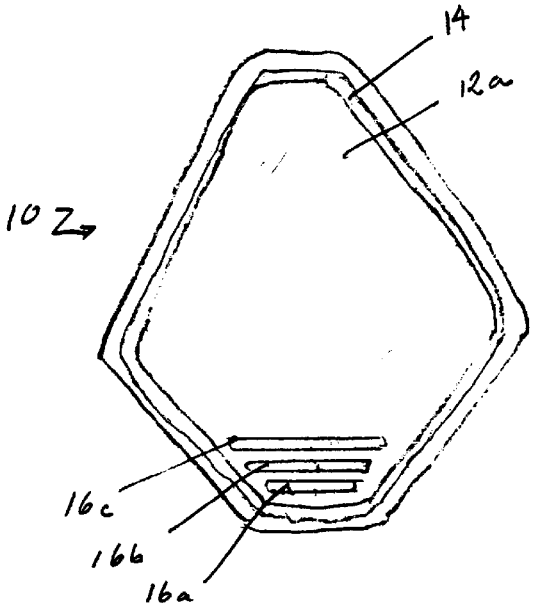
FIG. 2 is a top plan view of a second embodiment of a lipstick blotter according to the present invention.
Figure 3:
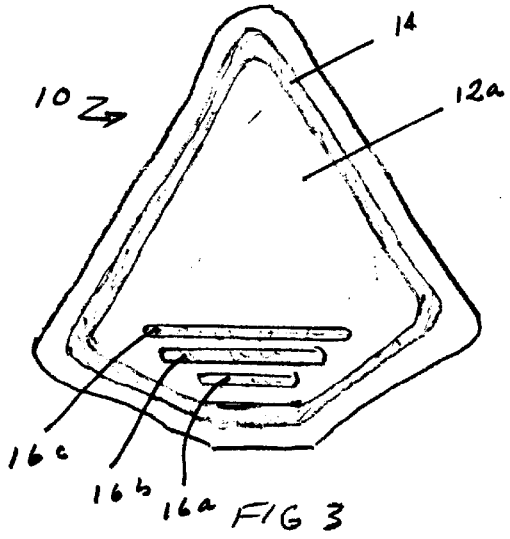
FIG. 3 is a top plan view of a third embodiment of the present invention.
Figure 4:
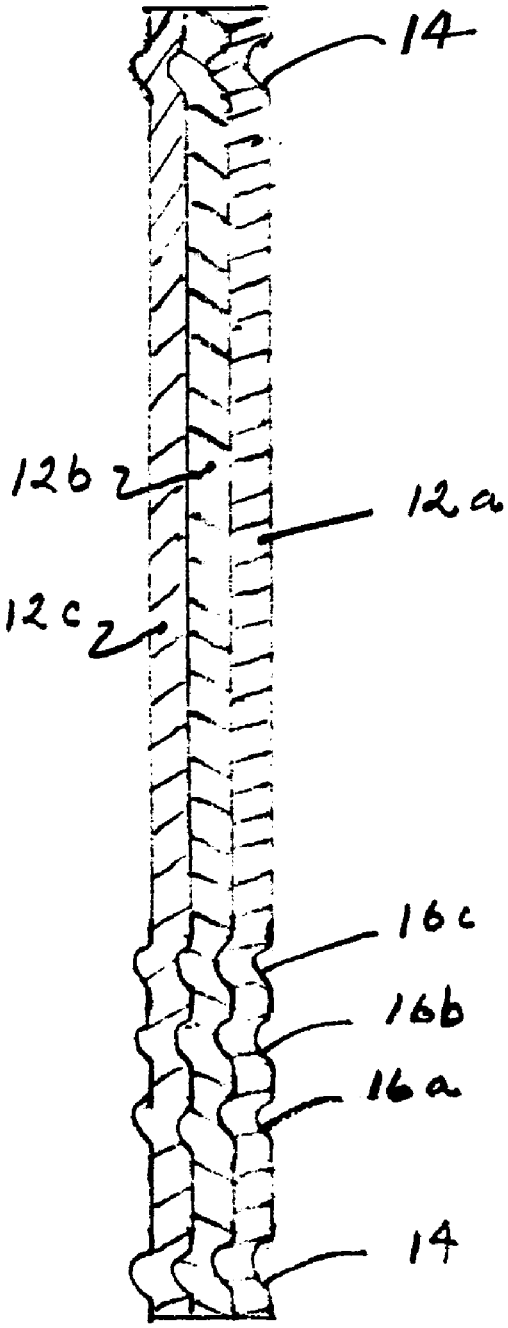
FIG. 4 is an enlarged cross-sectional view taken along the line 4—4 in FIG. 1.

A lipstick blotter 10 according to the present invention is shown in FIGS. 1–3, with each of the figures showing a different shape thereof. FIGS. 1 and 3 show a generally triangular-shaped blotter 10 and FIG. 2 shows a generally diamond-shaped blotter 10 with a truncated top edge and bottom edge. Each lipstick blotter 10 is formed from three pieces of identically-shaped material 12*a*, 12*b* and 12*c*, as shown in FIG. 4. In a preferred embodiment, the material is constructed of a soft, absorbent material such as paper towel material, or rice paper. The three pieces of paper are sealed together by conventional pressure sealing, as shown at 14. Additionally, a finger-grip is formed on each of the lipstick blotters 10, again by conventional pressure sealing, as shown at 16*a*, 16*b* and 16*c*. Only three (3) strips 16*a*, 16*b* and 16*c* are shown, although it is understood that other configurations of pressure detents, as well as the number of pressure detents, could be used equally as well to perform the function of comprising a finger grip. The strips 16*a*, 16*b* and. 16*c* are located adjacent a bottom edge of the blotter. The generally pointed top edge opposite the bottom edge is used to insert between the open lips of a user.

In using the lipstick blotter 10, a user,grasps the finger grip of the blotter 10 and places the generally pointed end of blotter 10 between the open lips of a user. The lips are then firmly closed onto the blotter. The lipstick blotter is then pulled away from the mouth leaving the inside of the lips free and clear from excess lipstick. Another use of the present invention is to simply close the lips firmly onto a blotter and blot the lips onto the blotter in a conventional manner.

It is also contemplated that flavoring could be applied to the blotter during the manufacturing process so that the blotters have an attractive taste when used to blot lipstick from a user's lips.

While the fundamental novel features of the invention have been shown and described, it should be understood that various substitutions, modifications, and variations may be made by those skilled in the art, without departing from the spirit or scope of the invention. Accordingly, all such modifications or variations are included in the scope of the invention as defined by the following claims:

I claim:

1. A lipstick blotter comprising:

a plurality of identically-shaped sheets of a soft, absorbent material which are joined together one upon the other;

each sheet having a peripheral edge;

each sheet sized for insertion into a mouth of a user;

the sheets having a generally triangular shape with a base edge located at the base of the triangular shape, and an apex edge located opposite the base edge;

the sheets, prior to being joined together, oriented so that the base edges are joined together and the apex edges are also joined together;

the sheets joined together along a line extending around the corresponding peripheral edge of the sheets and the joined sheets provided with a finger grip means located on an outside surface of the joined sheets and adjacent the base edge of the joined sheets for using the joined sheets as a single unit.

2. The lipstick blotter according to claim 1 wherein the finger grip means includes a plurality of parallel, indented strips.

3. The lipstick blotter according to claim 1 wherein the finger grip means includes a plurality of parallel, protruding strips.

4. The lipstick blotter according to claim 1 wherein the plurality of sheets are joined together with pressure sealing.

5. The lipstick blotter according to claim 1 wherein the sheets are constructed of rice paper.

6. The lipstick blotter according to claim 1 wherein the sheets are constructed of paper towel material.

7. A lipstick blotter comprising:

a plurality of identically-shaped sheets of soft, absorbent material which are joined together one upon the other;

each sheet having a peripheral edge;

each sheet sized for insertion into a mouth of a user;

the sheets having a generally diamond shape with a bottom edge located at an apex of the diamond shape, and an upper edge located at an apex of the diamond shape opposite the bottom edge;

the sheets, prior to being joined together, oriented so that the bottom edges are joined together and the upper edges are also joined together;

the sheets joined together alone a line extending around the corresponding peripheral edge of the sheets; and the joined sheets provided with a finger grip means located on an outside surface of the joined sheets adjacent the bottom edge of the joined sheets for inserting the joined sheets into the mouth of a user.

8. The lipstick blotter according to claim 7 wherein the finger grip means includes a plurality of parallel, indented strips.

9. The lipstick blotter according to claim 7 wherein the finger grip means includes a plurality of parallel, protruding strips.

10. The lipstick blotter according to claim 7 wherein the plurality of sheets are joined together with pressure sealing.

11. The lipstick blotter according to claim 7 wherein the sheets are constructed of rice paper.

12. The lipstick blotter according to claim 7 wherein the sheets are constructed of paper towel material.

13. A lipstick blotter comprising:

a plurality of identically-shaped sheets of a soft, absorbent material which are joined together one upon the other;

each sheet having a peripheral edge;

each sheet sized for insertion into a mouth of a user;

the sheets, prior to being joined together, oriented so that the shape of the joined sheets have the same shape as a single sheet;

the sheets joined together alone a line extending around the corresponding peripheral edge of the sheets; and the joined sheets provided with a finger grip means located at an outside surface of the joined sheets adjacent an edge of the joined sheets for inserting the joined sheets into the mouth of a user.

14. The lipstick blotter according to claim 13 wherein the finger grip means includes a plurality of parallel, indented strips.

15. The lipstick blotter according to claim 13 wherein the finger grip means includes a plurality of parallel, protruding strips.

16. The lipstick blotter according to claim 13 wherein the plurality of sheets are joined together with pressure sealing.

17. The lipstick blotter according to claim 13 wherein the sheets are constructed of rice paper.

18. The lipstick blotter according to claim 13 wherein the sheets are constructed of paper towel material.

* * * * *